US010359160B2

(12) United States Patent
Feng

(10) Patent No.: US 10,359,160 B2
(45) Date of Patent: Jul. 23, 2019

(54) LIGHT EMITTING DEVICE FOR A CONTAINER

(71) Applicant: Xia Feng, Chongqing (CN)

(72) Inventor: Xia Feng, Chongqing (CN)

( * ) Notice: Subject to any disclaimer, the term of this patent is extended or adjusted under 35 U.S.C. 154(b) by 46 days.

(21) Appl. No.: 15/590,821

(22) Filed: May 9, 2017

(65) Prior Publication Data

US 2017/0363259 A1 Dec. 21, 2017

(30) Foreign Application Priority Data

Jun. 20, 2016 (CN) ..... 2016 2 0603152 U

(51) Int. Cl.

| | |
|---|---|
| ***F21L 4/02*** | (2006.01) |
| ***F21V 21/08*** | (2006.01) |
| ***A47G 19/22*** | (2006.01) |
| ***F21V 21/005*** | (2006.01) |
| ***F21V 33/00*** | (2006.01) |

(52) U.S. Cl.

CPC ..... *F21L 4/027* (2013.01); *F21V 21/0808* (2013.01); *A47G 2019/2238* (2013.01); *A47G 2200/08* (2013.01); *F21V 21/005* (2013.01); *F21V 33/0004* (2013.01)

(58) Field of Classification Search

CPC ..... A61J 1/03; F21K 9/00; F21L 4/027; F21L 4/00; F21S 8/00; F21S 8/03; F21S 9/02; F21V 15/01; F21V 3/00; F21V 5/04; F21V 21/00; F21V 21/08; F21V 21/0808; F21V 23/005; F21Y 2103/10; F21Y 2105/10; H05K 1/00; H01L 23/28; H01L 23/295; H01L 23/3107; H01L 23/3121; H01L 23/315; H01L 23/49589; H01L 23/49822; H01L 23/5389

See application file for complete search history.

(56) References Cited

U.S. PATENT DOCUMENTS

| | | | | | |
|---|---|---|---|---|---|
| 5,002,424 | A * | 3/1991 | Hedgewick | E01F 9/553 | 359/531 |
| 5,703,719 | A * | 12/1997 | Chen | F21S 9/037 | 359/515 |
| 5,782,552 | A * | 7/1998 | Green | F21S 9/037 | 362/183 |
| 5,816,737 | A * | 10/1998 | Siblik | E01F 9/553 | 404/13 |

(Continued)

FOREIGN PATENT DOCUMENTS

| | | | |
|---|---|---|---|
| CN | 103180660 | A | 6/2013 |
| CN | 203921494 | U | 11/2014 |
| CN | 205227151 | U | 5/2016 |

*Primary Examiner* — Bryon T Gyllstrom

(74) *Attorney, Agent, or Firm* — Jeanette Meng Nakagawa

(57) ABSTRACT

The present disclosure directs to a light-emitting device configured for attachment onto a container. The device comprises a bottom layer and a filling layer atop with a central cavity to house electronic components arranged onto a circuit board, wherein the filling layer further comprises at least one extension, one cutout notch, and at least one light emitting LED arranged onto the circuit board around the extension. A bonding layer covers the top surface of the filling layer with a removable isolation paper. The circuit board and electronic components are protected form liquid corrosion and from blunt force while adhered onto the container.

3 Claims, 1 Drawing Sheet

(56) References Cited

U.S. PATENT DOCUMENTS 5,984,570 A * 11/1999 Parashar ..... E01F 9/559 362/153.1
6,210,017 B1 * 4/2001 Miura ..... F21S 8/022 362/153
6,420,008 B1 * 7/2002 Lewis ..... A44C 15/0015 156/250
7,088,222 B1 * 8/2006 Dueker ..... B60Q 7/00 340/321
7,578,597 B2 * 8/2009 Hoover ..... F21V 21/0824 362/153.1
7,704,080 B2 * 4/2010 Naumann ..... B25F 5/02 439/276
7,794,103 B2 * 9/2010 Hoover ..... E01F 13/044 362/153.1
7,868,903 B2 * 1/2011 Wendler ..... G09F 9/33 345/619
8,092,053 B1 * 1/2012 Kopp ..... F21V 19/005 362/311.02
8,814,379 B2 8/2014 Griffiths et al.
9,399,844 B1 * 7/2016 King ..... G02B 6/0011
9,439,296 B2 * 9/2016 Akashi ..... G06F 17/5068
2003/0133750 A1 * 7/2003 Kim ..... E01F 9/559 404/16
2004/0125594 A1 * 7/2004 Wu ..... A47G 23/0309 362/101
2004/0141311 A1 7/2004 Chen
2005/0024858 A1 * 2/2005 Johnson ..... A47G 19/2227 362/154
2005/0246928 A1 * 11/2005 Lee ..... G09F 13/04 40/564
2006/0079127 A1 * 4/2006 Endo ..... H01L 21/4857 439/567
2006/0257205 A1 * 11/2006 Jordan ..... E01F 9/559 404/16
2007/0293088 A1 * 12/2007 Hiew ..... G06F 1/1632 439/607.41
2008/0220549 A1 * 9/2008 Nall ..... H05K 3/284 438/26
2014/0029210 A1 * 1/2014 Gowda ..... H01L 23/5389 361/746
2014/0264800 A1 * 9/2014 Gowda ..... H01L 24/83 257/675
2014/0374629 A1 * 12/2014 Huang ..... H04B 10/802 250/551
2015/0198314 A1 7/2015 Frederiksen
2016/0010846 A1 1/2016 Wu
2017/0207160 A1 * 7/2017 Gowda ..... H01L 23/49838

* cited by examiner

LIGHT EMITTING DEVICE FOR A CONTAINER

TECHNICAL FIELD

The present disclosure relates to the technical field of packaging, and in particular to a light-emitting device for a container.

BACKGROUND

Beverages or wine is one of the most commonly used consumer goods, these beverages or wine is accommodated in fixed containers, such as closed bottles, open cups and so on.

The existing light emitting device arranged on a bottle or a cup is adhered to the bottle or the cap by glue, the light emitting device is bore by a soft pad, after improvement, a filling layer is additionally arranged on the pad, and the filling layer can fill uneven places on the bottle, so that the stability of the bottle or the cup after placement is improved. A circuit board and electronic components and parts of the light emitting device are exposed from a middle area of the pad, and liquid in the bottle or the cup filled with liquid splashes onto the circuit board in a use process to damage the circuit board.

SUMMARY

The technical problem to be solved by the present disclosure is to provide a light-emitting device for a container, which is used more reliably.

The objective of the present disclosure is realized by the following technical solutions: a light emitting device for a container includes a pad and a circuit board arranged on the pad, an electronic element is arranged on an upper layer and/or a lower layer of the circuit board, a filling layer is further arranged on the pad, a bonding material layer is arranged on an upper surface of the filling layer, a piece of removable isolation paper is further adhered on the bonding material layer, and the bonding material layer is attached to the container; and a middle area of the filling layer is provided with a hollow area to expose the electronic element on the circuit board, and at least one inward extension part in the hollow area of the filling layer is placed above the circuit board.

Preferably, the light-emitting component includes two button cells arranged on the circuit board, and the extension part is arranged at a gap between the two button cells.

Preferably, two extension parts are provided, and the two extension parts are arranged at two gaps between the two button cells.

Preferably, the filling layer is provided with one or more notches by cutting.

Preferably, pluralities of notches are provided, and are distributed on the filling layer and evade the position of the extension part of the filling layer.

Preferably, a light source of the light-emitting component is an LED, and the LED is arranged to evade the extension part of the filling layer.

The present disclosure has the beneficial effects that as the inward extension part is arranged in the hollow area of the pad to wrap the circuit board, leakage of liquid onto the circuit board in the use process is avoided, and the reliability of the light emitting device is improved.

DETAILED DESCRIPTION OF THE EMBODIMENTS

A preferred embodiment of the present disclosure will be described below, and those of ordinary skill in the art can achieve it in accordance with related technology in the art described below and can be more aware of the innovations and the benefits of the present disclosure.

Figure 1:
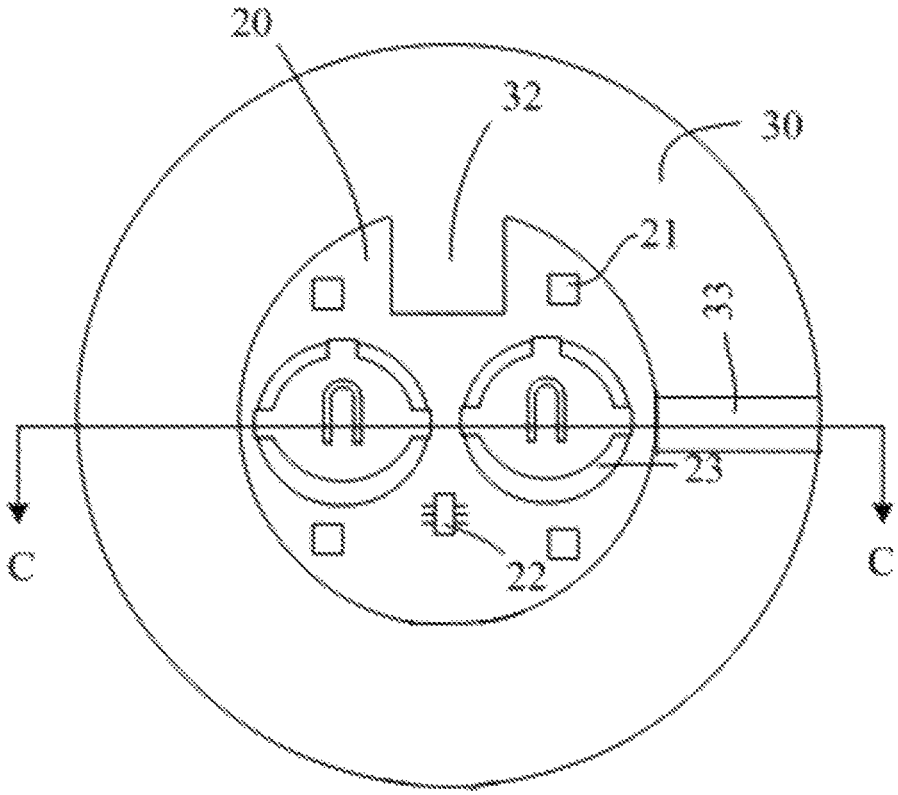
FIG. 1 is a structural schematic diagram of a light-emitting device of an embodiment of the present disclosure.
Figure 2:
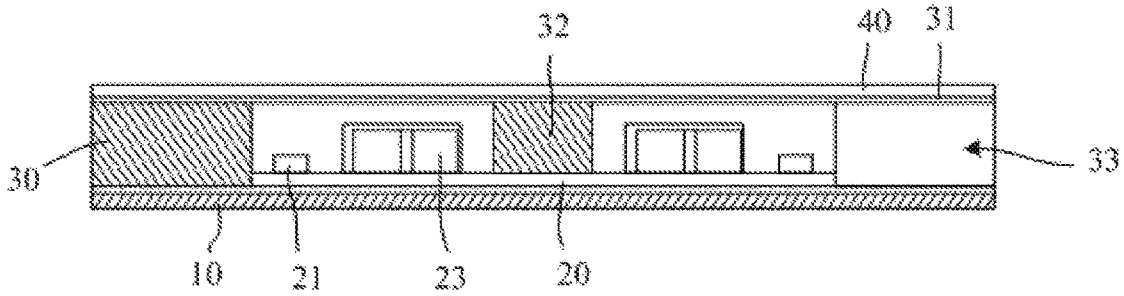
FIG. 2 is a schematic diagram of a C-C section of FIG. 1.

FIG. 1 and FIG. 2 show a specific embodiment of the light-emitting device for a container of the embodiment. The container includes a bottle, a cup or other containers for bearing beverage or wine, the light emitting device includes a bottom pad layer 10 and a circuit board 20 arranged on the pad 10, the circuit board 20 is provided with a light emitting component 21. The pad 10 is further provided with a filling layer 30, a bonding material layer 31 is arranged on the surface of the filling layer 30, a removable isolation layer 40 is adhered on top of the bonding material layer 31, which is attached to the bottom or other positions of the container; a middle area of the filling layer 30 is provided with a hollow structure to expose the light emitting component on the circuit board 20, and at least one inward extension part 32 is arranged on the edge of the hollow structure to wrap and to secure the circuit board. According to the present disclosure, as the inward extension part is arranged in the hollow area of the pad, with bonding material all around, leakage of liquid onto the circuit board in a use process is avoided, and the use reliability of the light-emitting device is improved.

In the present embodiment, as shown in FIG. 1 and FIG. 2, the light-emitting component includes one or more button cells 23 arranged on the circuit board 20, and the extension part 32 is arranged at a gap between the two button cells 23. In the present embodiment, the gap is a fan-shaped gap between the two button cells 23 as shown in FIG. 1, therefore the majority of the circuit board is exposed herein, and accordingly a fault of the circuit is caused easily due to the invasion of the liquid.

As further improvement of the present embodiment, two extension parts 32 are provided, and the two extension parts 32 are arranged at two gaps between the two button cells 23. Similarly, a resistor 22 is also arranged at the gap between the two button cells and is closer to the central area of the hollow structure.

In the present embodiment, the filling layer 30 is further provided with one or more notches 33, as the bonding material layer 31 is generally 3M glue or other super glue, the bonding performance is strong, therefore the phenomenon that the isolation paper is hard to tear off during use happens sometimes. In the present embodiment, due to the arrangement of the notches 33, the isolation paper is torn off more easily during use, and meanwhile the notch also reduces the bonding area of the light emitting device at the bottom of the bottle, therefore the light emitting device is taken off more conveniently and easily. Of course, a plurality of notches can also be provided. When a plurality of notches are provided, the plurality of notches can be uniformly distributed on the filling layer and evade the position of the extension part, in this way, the circuit board can be protected better, and meanwhile the isolation paper can be torn off more easily.

In the present embodiment, light source of the light emitting component is a plurality of LEDs labeled as 21. The LED 21 has the properties of small volume, low energy consumption and high brightness, the LED can be arranged on both sides of the extension part 32 herein to reserve a larger place, so that the circuit board can be covered by the extension part, and accordingly the damage risk is reduced.

The above contents are further detailed descriptions of the present disclosure in combination with the specific preferred embodiment, however, the specific implementation of the present disclosure cannot be deemed as being merely limited to these descriptions. For those of ordinary skill in the art to which the present disclosure belongs, a lot of simple deductions or substitutions can also be made without departing from the concept of the present disclosure, for example, an external motor or hydraulic power and other driving modes can be adopted, beside the embodiments described above, the traction mode can also adopt a steel cable or other traction modes, and all these should be deemed as belonging to the protection scope of the present disclosure.

What is claimed is:

1. A light emitting device configured for attachment onto a container, comprising:

a bottom layer;

a filling layer situated above the bottom layer with a perimeter region and a central cavity to house electronic components arranged onto a circuit board, wherein the filling layer further comprises at least one extension from the perimeter region towards the central cavity to cover a portion of the circuit board;

at least one cutout notch at an edge of the filling layer; and at least one light emitting LED arranged onto the circuit board around the extension; and a bonding layer to cover top surface of the filling layer with a removable isolation paper further atop, without which is adhered onto the container.

2. The light emitting device for a container of claim 1, wherein the electronic components further comprise at least one battery cell arranged onto the circuit board.

3. The light emitting device for a container of claim 1, wherein the extension of the filling layer further cover portions of the circuit board.

* * * * *